United States Patent [19]

Miller et al.

[11] Patent Number: 4,620,358

[45] Date of Patent: Nov. 4, 1986

[54] METHOD OF SECURING EQUIPMENT PARTS TO A TRACKWAY SUPPORTING STRUCTURE

[75] Inventors: Luitpold Miller; Hans G. Raschbichler, both of Ottobrunn, Fed. Rep. of Germany

[73] Assignee: Thyssen Industrie AG, Fed. Rep. of Germany

[21] Appl. No.: 698,351

[22] Filed: Feb. 5, 1985

[30] Foreign Application Priority Data

Feb. 6, 1984 [DE] Fed. Rep. of Germany ..... 3404061

[51] Int. Cl.[4] ..... B23Q 3/00

[52] U.S. Cl. ..... 29/464; 29/526 R; 104/281

[58] Field of Search ..... 29/445, 464, 526 R; 104/89, 286, 281

[56] References Cited

U.S. PATENT DOCUMENTS

| | | | |
|---|---|---|---|
| 3,034,611 | 5/1962 | Zenzic | 29/526 R X |
| 3,254,399 | 6/1966 | Zahuranec | 29/464 X |
| 3,511,186 | 5/1970 | Barthalon | 104/89 |
| 3,631,807 | 1/1972 | Cherto | 104/89 |
| 3,842,749 | 10/1974 | Schwarzler | 104/281 X |
| 3,885,505 | 5/1975 | Winkle et al. | 104/281 X |
| 4,064,808 | 12/1977 | Nakamura et al. | 104/281 X |

*Primary Examiner*—Charlie T. Moon

*Attorney, Agent, or Firm*—McGlew and Tuttle

[57] ABSTRACT

The feature characterizing the method is that in an operation following the finishing of the track supporting structure, the mounting bodies are machined in a way such as to correct the structural inaccuracies caused by manufacturing tolerances of the prior art steel and concrete construction, to obtain an accurate mutual position of the equipment parts at the location of attachment. For this purpose, preferably, the mounting bodies are provided at the securing locations with bores and countersinks which are accurate in all the coordinates and correspond to the bolts or bores of the equipment parts, to finally mount these parts by means of bolts and spacer bushings. In supporting structures of steel tracks, mounting bodies accessible from both sides are preferably employed.

6 Claims, 10 Drawing Figures

METHOD OF SECURING EQUIPMENT PARTS TO A TRACKWAY SUPPORTING STRUCTURE

FIELD AND BACKGROUND OF THE INVENTION

This invention relates in general to transportation systems and in particular to a new and useful method of securing equipment parts to a trackway supporting structure.

Concrete or steel track structures for track-following systems of transportation, particularly magnetic suspension railroads, comprise upright single or multiple trusses, or ground sections, with the working surfaces or parts of equipment needed for support, guidance, drive, braking, data transmission to the control station, and current transmission into the vehicle such as reaction rails, current rails, etc., being mounted on the supporting structure in exact position through adjustable screw connections or by means of securing bolts or securing lugs embedded in the concrete. From German Pat. No. OS 27 15 717 (U.S. Pat. No. 4,064,808 to Nakamura et al.), it is known to clamp a reaction rail in place in exact position, while using adjustable screw connections to compensate for the manufacturing tolerances of the supporting concrete structure. The accurate fixing by means of embedded securing bolts is shown in the German periodical Glaser Annalen, 105(181), No. 7/8, page 210. According to that disclosure, the needed positional accuracy is ensured directly at the site after a preliminary accurate adjustment of the track equipment, by introducing mortar and thus fixing the securing bolts in place. This, however, requires a preceding accurate adjustment and holding of the track equipment in the adjusted position during the casting and until the mortar solidifies. The adjustable screw connection is also known from Glasers Annalen. In FIG. 13 on page 213 of the mentioned reference, it is shown how the longitudinal stator plates are connected to the track support, or the joint working component, through adjustable securing elements. Adjustable securing elements require a considerable amount of screw and connection elements, if the equipment parts are to be exactly positioned and firmly secured to the track structure, and the mounting costs, up to the final adjustment of the parts in positions variable by screwing, are high. The working. components and equipment parts can be structurally united only in few individual instances, since frequently materials are needed for the equipment parts having coefficients of expansion different from those of steel and concrete, or the construction does not allow such a unification, for example, a laminated stator for a longitudinal stator drive fixed to the track, or a correspondingly exact fabrication of the working surface as a component of the supporting structure are not feasible technically or justifiable economically.

SUMMARY OF THE INVENTION

Starting from this prior art, the invention is directed to a method permitting the fixing of the equipment parts to the supporting structure of the trackroad in a simple way, i.e. with a small number of securing elements and adjustment devices and with a minimum of mounting costs.

Accordingly, it is an object of the invention to provide an improved method for securing equipment parts in accurate positions to a structure supporting a track following system of transportation, particularly a magnetic suspension railroad which comprises constructing a supporting structure and in accordance with the layout of the track in reference to the working surfaces of the parts of equipment, connecting mounting bodies to the supporting structure which have a plurality of thruholes and countersinks of a number needed for mounting the part of equipment corresponding to the respective bolts and bores thereof and being made to exact dimensions in all coordinates.

A further object of the invention is to provide a method of erecting a support structure which includes a trackway and a plurality of equipment parts secured to the structure which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
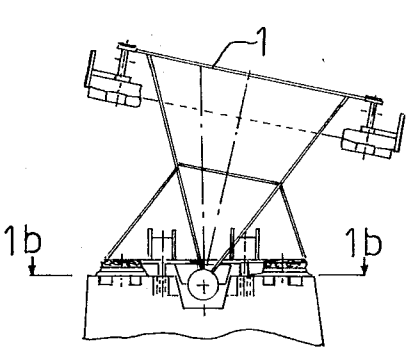
FIG. 1 is a diagrammatical transverse sectional view of a trackway structure constructed in accordance with the invention.
Figure 1B:
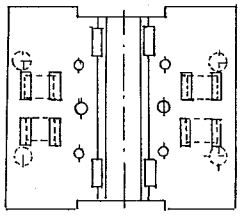
FIG. 1*b* is a section taken along the line 1*b*—1*b* of FIG. 1.
Figure 1A:
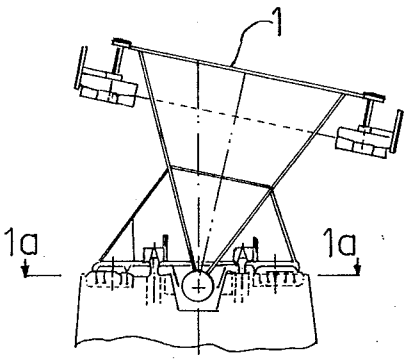
FIG. 1*a* is a section taken along the line 1*a*—1*a* of FIG. 1.
Figure 1C:
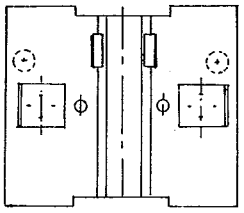
FIG. 1*c* is a side elevational view of the trackway shown in FIG. 1.
Figure 1C:
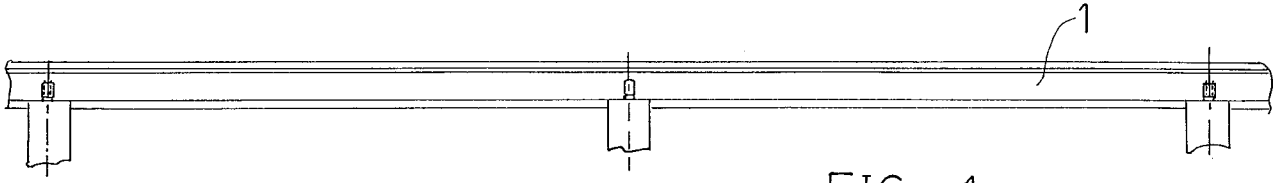

Referring to the drawings in particular the invention embodied therein comprises a method of securing equipment parts in accurate positions at predetermined locations of connections to a structural supporting track following system of transportation which is indicated in FIG. 1. In accordance with the invention, a magnetic suspension railroad has a supporting structure which includes mounting bodies which are provided at locations of attachment and dimension for transferring to the supporting structure forces and torques which act through the vehicle onto the parts of the equipment. With the inventive method, the supporting structure is completed and in accordance with the layout of the track as referred to the working surface of the parts of equipment. Mounting bodies are connected to the supporting structure are provided with a plurality of thruholes and countersinks of a number needed for mounting the part of the equipment corresponding to the respective bolts and bores thereof and having the exact dimensions in all coordinates. The track supporting structure may be made of steel and the mounting bodies are accessible from both sides and provided with bores and countersinks which are exact in all coordinates and the equipment is mounted by means of bolts, spacer bushings and nuts. The mounting bodies may also be connected to the untensioned reinforcement of the steel concrete forming the structure and backed with a filling material at their side facing the concrete. A foam material may be employed as filling material.

Figure 4:
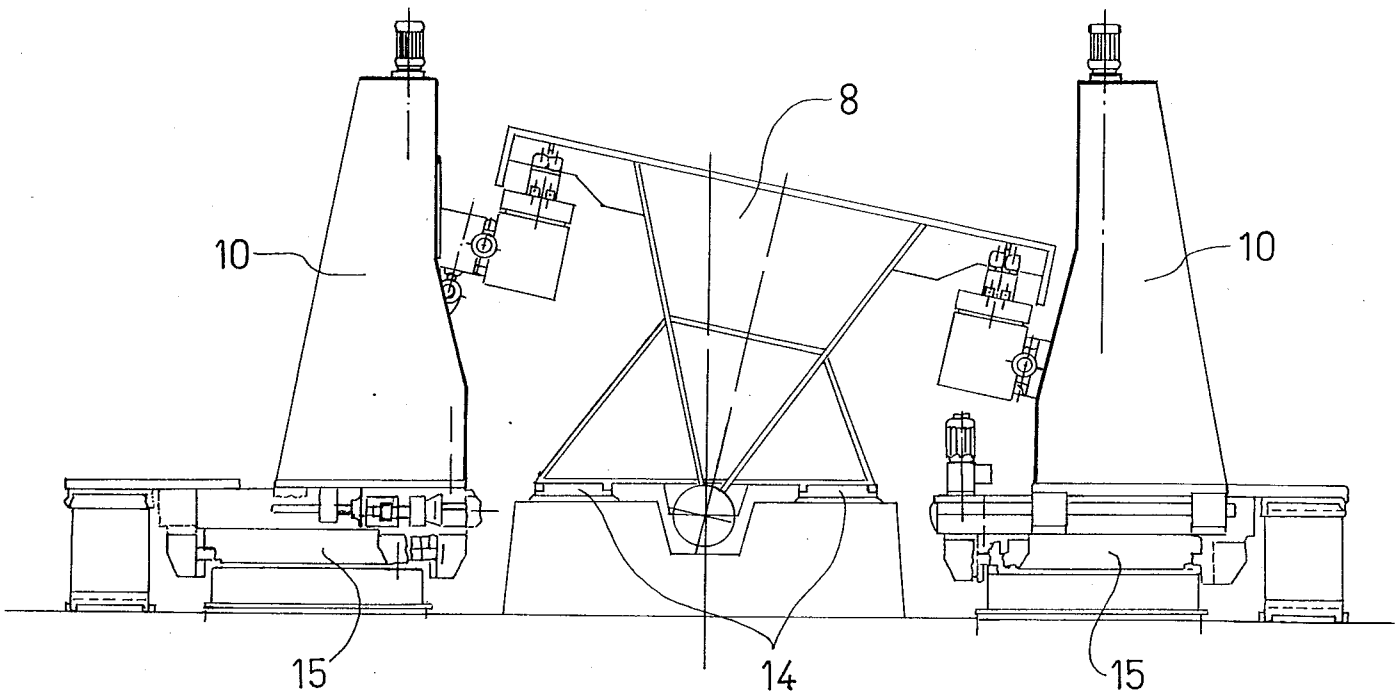
FIG. 4 is a view of the rail support structure indicating computer control drilling devices employed in accordance with the invention.
Figure 5:
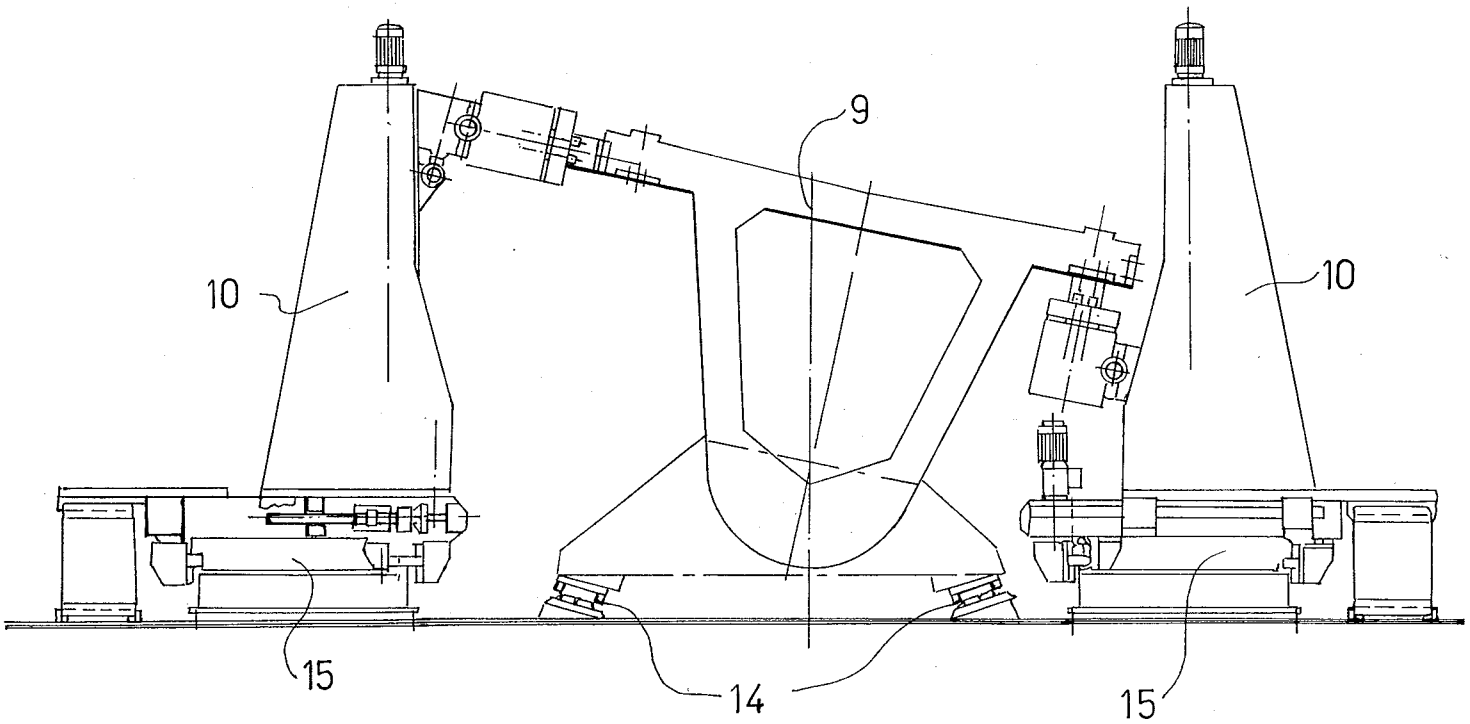
FIG. 5 is a view similar to FIG. 4 of another embodiment of the invention.

When the track supporting structures are designed as steel supports, reinforced concrete supports or structural units of ground track, road mounting bodies are drilled and countersunk by means of one or more computer controlled drilling tools as shown in FIGS. 4 and 5.

Figure 2B:
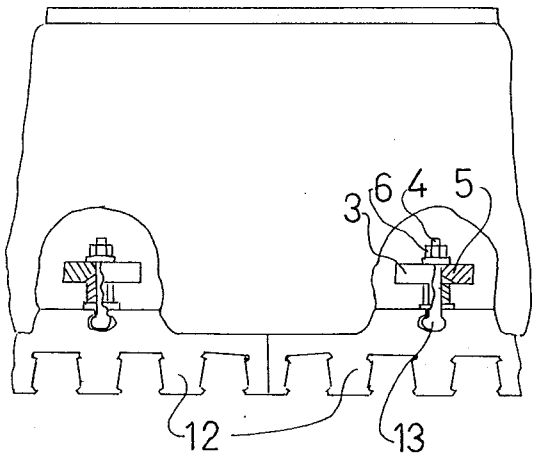
FIG. 2*b* is a section taken along the line 2*b*—2*b* of FIG. 2*a;*
Figure 2A:
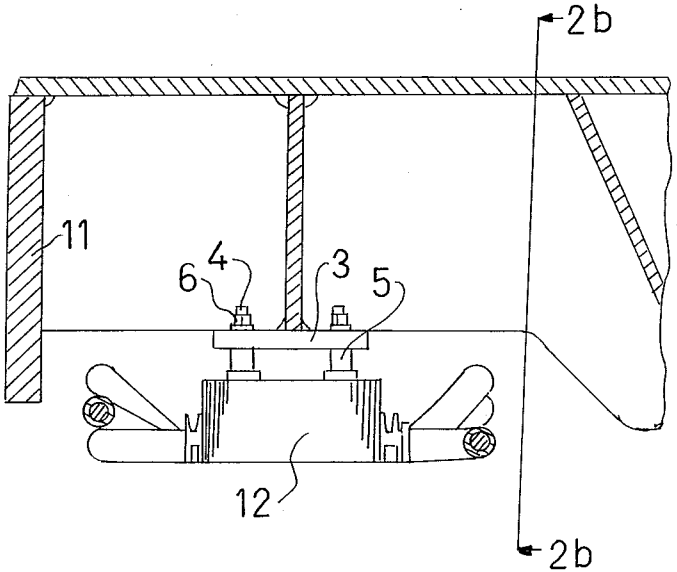
FIG. 2*a* is an enlarged detail of a portion of the structure shown in FIG. 1 indicating the method of mounting additional equipment in accordance with the invention.
Figure 3A:
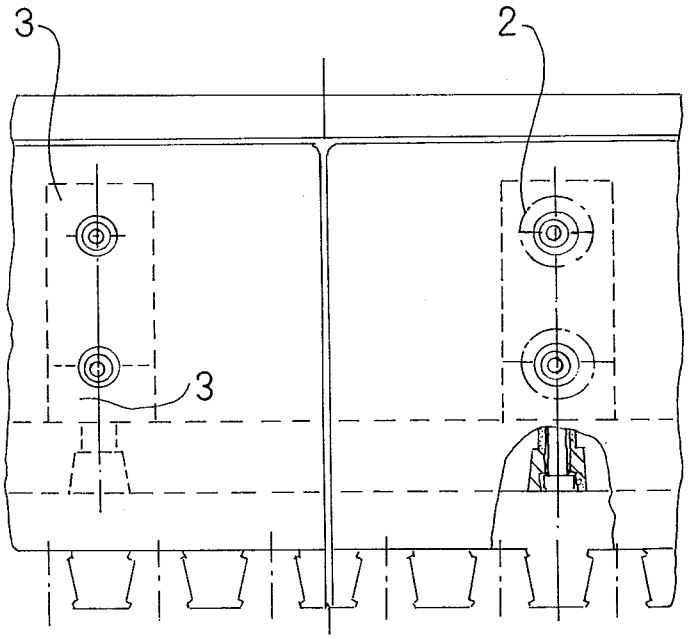
FIG. 3A is a section taken along the line 3A—3A of FIG. 3.
Figure 3:
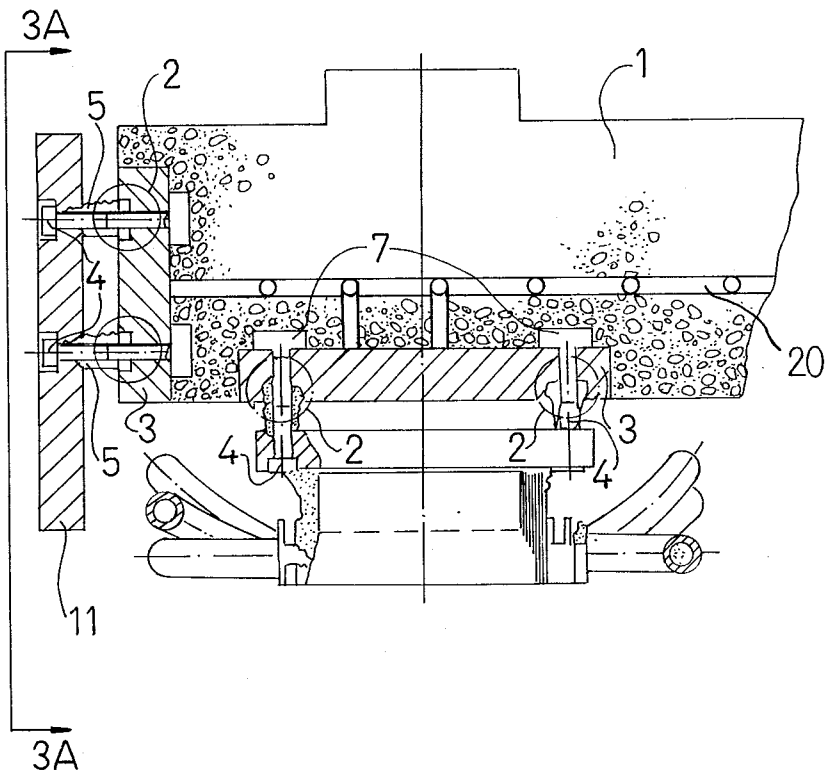
FIG. 3 is an enlarged sectional view showing the manner of securing the equipment to a concrete structure.

As may be learned from FIGS. 2 and 3, only bolts 4 and spacer bushings 5 are needed for securing equipment parts, such as a lateral guide rail 11, to a concrete track through mounting bodies 3 at attachment locations 2, with the mounting bodies being backed in the concrete, in line with the bores, with a foam filler material 7. The stator plates are secured similarly. FIG. 3 shows the untensioned reinforcement 20 of the steel concrete 1, to which mounting bodies 3 which are in the form of flat plates, are connected.

The securing shown in FIG. 2, of stator plates 12 to a steel track 1 requires only sliding blocks 13 with bolts 4, collets 5, and nuts 6. As shown, the minimum number of needed mounting parts and the simple way of fixing by non-adjustable screw connections reduce the mounting expenses to a minimum and, since the securing becomes so simple, makes possible a large scale automation. An accurate positioning of the track equipment can thus be obtained with very small costs.

The accurate location of the corresponding thruholes, tapped holes, and countersinks, can be obtained in a particularly economical way be employing computer controlled drilling devices 10 shown in FIGS. 4 and 5. To this end, the track support 8 (FIG. 4) or 9 (FIG. 5), or the track supporting structure in accordance with the bearings 14 provided at the respective location of a track, is immobilized and then the mounting bodies are provided with accurately positioned and dimensioned bores, countersinks, and tapholes computed from the required layout of the track. The same guide rails 15 on which the drilling devices are guided in the longitudinal direction of the track structure or track supports, may then be used for fully automatically mounting the equipment parts on the supporting structure.

While specific embodiments of the invention have been shown and described in detail to illustrate the application of the principles of the invention, it will be understood that the invention may be embodied otherwise without departing from such principles.

What is claimed is:

1. A method of securing equipment parts in accurate positions at predetermined locations of connection to an elevated suspension structure supporting a track following system of transportation, particularly a magnetic suspension railroad, comprising providing mounting bodies for the supporting structure at locations of attachment and dimensioned for transferring to the supporting structure force and torques which act through a vehicle, connecting the mounting bodies at the desired attitude to the supporting structure in accordance with the layout of the track as referred to working surfaces of the parts of equipment, providing the mounting bodies after they are connected to the supporting structure with a plurality of thruholes and countersinks by drilling in a number needed for mounting the equipment part corresponding to the respective bolts and bores thereof and having the exact dimensions in all coordinates, laying out a plurality of additional elevated suspension supporting structures to form a layout of the track, repeating the above steps for connecting at least some of the mounting bodies to each of the plurality of additional elevated supporting structures and providing the thruholes and countersinks in said at least some of the connected mounting bodies and securing equipment parts to the mounting bodies using exact dimensioned bolts received in the holes drilled therein.

2. A method according to claim 1, wherein said track supporting structure is made of steel and wherein the mounting bodies are accessible from both sides and provided with bores and countersinks which are exact in all coordinates and including mounting the equipment parts by means of bolts, spacer bushings and nuts.

3. A method according to claim 1, wherein the track supporting structure is constructed of a steel concrete, said mounting bodies being connected to an untensioned reinforcement of the steel concrete and backed with a filling material at their side facing the concrete.

4. A method according to claim 3, wherein foam material is employed as a filling material.

5. A method according to claim 4, including securing the equipment part using spacer bushings and nuts engaged on the bolts.

6. A method according to claim 1, wherein said track supporting structure comprises a steel support reinforced concrete supports and structurally units of ground track road, and wherein the mounting bodies are drilled and countersunk by means of one or more computer controlled drilling tools.

* * * * *